US006205993B1

(12) United States Patent
Zehavi et al.

(10) Patent No.: US 6,205,993 B1
(45) Date of Patent: Mar. 27, 2001

(54) METHOD AND APPARATUS FOR FABRICATING ELONGATE CRYSTALLINE MEMBERS

(75) Inventors: Raanan Zehavi; Robert Davis, both of Livermore, CA (US)

(73) Assignee: Integrated Materials, Inc., San Jose, CA (US)

( * ) Notice: Subject to any disclaimer, the term of this patent is extended or adjusted under 35 U.S.C. 154(b) by 0 days.

(21) Appl. No.: 09/292,496

(22) Filed: Apr. 15, 1999

(51) Int. Cl.[7] ..... B28D 1/04

(52) U.S. Cl. ..... 125/13.01; 125/24; 125/23.01; 125/23.02; 83/872

(58) Field of Search ..... 125/13.01, 24, 125/23.01, 23.02; 83/872–874; 451/41

(56) References Cited

U.S. PATENT DOCUMENTS

| | | | | |
|---|---|---|---|---|
| D. 404,371 | | 1/1999 | Shimazu . | |
| D. 411,176 | | 6/1999 | Shimazu . | |
| 3,247,576 | * | 4/1966 | Enderlin et al. | 125/23.01 |
| 3,901,423 | * | 8/1975 | Hillbery et al. | 125/23.01 |
| 4,177,789 | * | 12/1979 | Marocco | 451/41 |
| 4,318,749 | | 3/1982 | Mayer . | |
| 4,566,839 | | 1/1986 | Butler . | |
| 4,872,554 | | 10/1989 | Quernemoen . | |
| 4,911,002 | * | 3/1990 | Hillberry et al. | 125/23.01 |
| 4,914,269 | | 4/1990 | Kinsman et al. . | |
| 4,955,357 | * | 9/1990 | Takeguchi et al. | 125/23.01 |
| 4,966,549 | | 10/1990 | Ohdate . | |

(List continued on next page.)

FOREIGN PATENT DOCUMENTS

| | | | | |
|---|---|---|---|---|
| 0506052A1 | | 9/1992 | (EP) . | |
| 0793260A1 | | 9/1997 | (EP) . | |
| 1630907 | * | 2/1991 | (RU) | 125/23.01 |
| 00/21119 | | 4/2000 | (WO) . | |

OTHER PUBLICATIONS

"Information about Silicon Furnace Tubes," Dow Corning, no date, 4 pp.
"Polyboat: Series 7700," Semiconductor Specialties Corp., no date, pp 1–24.
"1979 Catalog Supplement," Semiconductor Specialties Corp., no date, 3 pp.

*Primary Examiner*—David A. Scherbel
*Assistant Examiner*—George Nguyen
(74) *Attorney, Agent, or Firm*—Charles S. Guenzer; Patrick N. Burkhart

(57) ABSTRACT

A method for fabricating elongate structural members from a unitary blank of crystalline material is provided. The blank has a predetermined length, width, and depth. A first substantially planar cut is made in the blank, the cut extending substantially along the entire length of the blank and substantially less than the entire width of the blank. At east one additional cut is made in the blank, the at least one additional cut extending in the same plane as the first cut, to cut the blank into two pieces. The step of making at least one additional cut can include making a plurality of additional cuts, in one embodiment at least three additional cuts. The cuts can be made using a rotary saw with a blade having diamond-coated cutting surfaces. The saw can be operated with the blade rotating at between 50 rpm and 50,000 rpm, preferably at approximately 4,000 rpm. The blank of crystalline material can be provided as a unitary blank of silicon material. The method of the present invention can be practiced using monocrystalline silicon material or polyaystalline silicon material. In an embodiment, the blank can be provided as a generally cylindrical blank. The step of making a first substantially planar cut and the step of making at least one additional cut can be repeated on each of the two pieces to make four pieces from the original cylinder, and subsequently repeated to yield eight pieces from the original cylinder, each of the eight pieces having a substantially wedge-shaped cross-section.

20 Claims, 2 Drawing Sheets

U.S. PATENT DOCUMENTS

| | | | | |
|---|---|---|---|---|
| 5,020,476 | | 6/1991 | Bay et al. . | |
| 5,468,297 | | 11/1995 | Letort . | |
| 5,492,229 | | 2/1996 | Tanaka . | |
| 5,534,074 | | 7/1996 | Koons . | |
| 5,586,880 | | 12/1996 | Ohsawa . | |
| 5,595,604 | | 1/1997 | Kobayashi et al. . | |
| 5,658,103 | | 8/1997 | Inokuchi et al. . | |
| 5,752,609 | | 5/1998 | Kato et al. . | |
| 5,779,797 | | 7/1998 | Kitano . | |
| 5,820,683 | | 10/1998 | Ishii et al. . | |
| 5,858,103 | | 1/1999 | Nakajima et al. . | |
| 5,915,370 | * | 6/1999 | Dill, Jr. et al. | 125/23.01 |
| 5,921,229 | | 1/1999 | Lee . | |
| 5,931,666 | | 8/1999 | Hengst . | |

* cited by examiner

METHOD AND APPARATUS FOR FABRICATING ELONGATE CRYSTALLINE MEMBERS

CROSS-REFERENCE TO RELATED APPLICATIONS

This application is related to U.S. Ser. No. 09/292,491, and U.S. Ser. No. 09,292,495, filed of even date herewith, the specifications of which are incorporated by reference herein.

FIELD OF THE INVENTION

The present invention relates generally to the fabrication of elongate crystalline structural members. Specifically, the present invention relates to the fabrication of monocrystalline and polycrystalline silicon structural members for use in the manufacture of semiconductor wafers and the like.

BACKGROUND OF THE INVENTION

In the evolution of commercial fabrication of semiconductor wafer, larger and larger wafers are processed in bigger and bigger batches. Such processing has pushed the performance envelope of processing equipment, as well as that of the wafer handling and carrying mechanisms needed to move, transport, and retain the wafers during processing.

In many chemical and thermal processing operations, it is often necessary to hold the wafers in precise positions during various processing steps. Relatively large and complex structures such as "boats" or "towers" are typically employed to that end. One example of such a structure is described in U.S. Pat. No. 5,492,229 to Tanaka et al. The Tanaka et al. patent is directed to a vertical boat for holding a plurality of semiconductor wafers. The boat includes two end members and a plurality of support members. In one embodiment, the support members are formed from pipe members cut vertically to provide a long plate member having a cross section of a quarter-circular arc. In another embodiment, the support members are formed from pipe members cut vertically to provide a long plate member having a cross section of a semicircular arc. The Tanaka et al. patent lists as potential materials for its boats the following: silica glass, silicon carbide, carbon, monocrystal silicon, polycrystal silicon, and silicon carbide impregnated with silicon. The various components are to be welded together if made from silica glass; otherwise, "they may be assembled in a predetermined manner".

The theoretical advantages provided by pure silicon structures are well known. Conventional towers and boats are typically made from quartz, which introduces contamination and becomes unstable at higher temperatures. By fabricating wafer holding structures from the same materials as the wafers themselves, the possibility of contamination and deformation would be minimized. The structure would react to processing temperatures, conditions, and chemistry in exactly the same way that the wafers would, thus greatly enhancing the overall effective useful life of the structure.

Unfortunately, standard assembly of silicon structures in a "predetermined manner" as set forth in Tanaka et al. is one of the reasons that pure silicon has not gained wide acceptance as a material for structures such as boats and towers. The difficulties of working with monocrystalline and polycrystalline silicon have led to the development of structures such as that shown in Tanaka et al. When considering monocrystalline silicon as the material of choice in such structures, the Tanaka et al. patent fails to describe the connections between the support members and the end members. The only specifically described method of fabricating support structures involves cutting extruded tubular members. Such support structures are inherently less stable than those made from more traditional and easily-worked materials such as quartz or silicon carbide.

Silicon is perceived as being extremely fragile and difficult to weld. Due to these perceptions, known silicon structures are widely believed to be delicate at best, and unreliably flimsy at worst. Consequently, they have failed to receive broad commercial acceptance.

Furthermore, due to its molecular structure, blanks extruded from crystalline silicon have a distinct "grain" running generally longitudinally through the blank. Silicon blanks are usually cut laterally, across the grain, using a scroll saw. Unfortunately, when used to make longitudinal cuts, conventional cutting techniques tend to split silicon blanks along the grain, thus ruining the blank.

It can be seen that the need exists for a method of fabricating monocrystalline and polycrystalline silicon structural members for use in the manufacture of semiconductor wafers and the like that will eliminate the disadvantages of known silicon structures while retaining the advantages of silicon as a structural material

SUMMARY OF THE INVENTION

A method for fabricating elongate structural members from a unitary blank of crystalline material is provided. The blank has a predetermined length, width, and depth. A first substantially planar cut is made in the blank, the cut extending substantially along the entire length of the blank and substantially less than the entire width of the blank. At least one additional cut is made in the blank, the at least one additional cut extending in the same plane as the first cut, to cut the blank into two pieces.

The step of making at least one additional cut can include making a plurality of additional cuts, in one embodiment at least three additional cuts. The cuts can be made using a rotary saw with a blade having diamond cutting surfaces. The saw can be operated with the blade rotating at between 50 rpm and 50,000 rpm, preferably at approximately 4,000 rpm.

The blank of crystalline material can be provided as a unitary blank of silicon material. The method of the present invention can be practiced using monocrystalline silicon material or polycrystalline silicon material.

In an embodiment, the blank can be provided as a generally cylindrical blank or ingot. The step of making a first substantially planar cut and the step of making at least one additional cut can be repeated on each of the two pieces to make four pieces from the original cylinder, and subsequently repeated to yield eight pieces from the original cylinder, each of the eight pieces having a substantially wedgeshaped cross-section.

DETAILED DESCRIPTION OF THE INVENTION

Figure 1:
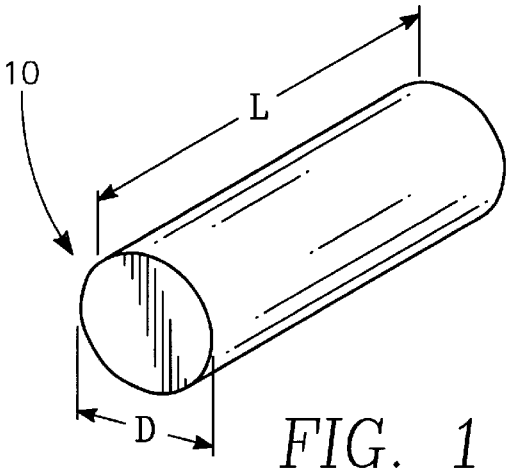
FIG. 1 illustrates a blank for use with the method of the present invention.

A blank 10 suitable for use with the method of the present invention is shown in FIG. 1. Although the blank 10 is generally cylindrical, with a length L and a diameter D, it is contemplated that the present invention is applicable to any suitable blank having virtually any configuration.

The blank 10 may be fabricated from a crystalline material, such as monocrystalline or poycrystalline silicon. Silicon blanks are widely available commercially. One supplier of suitable silicon blanks is SILICON CRYSTALS INC. Blanks can be manufactured in any size, but are typically between 4" and 80" long, with a diameter between 0.75" and 36".

Figure 2:
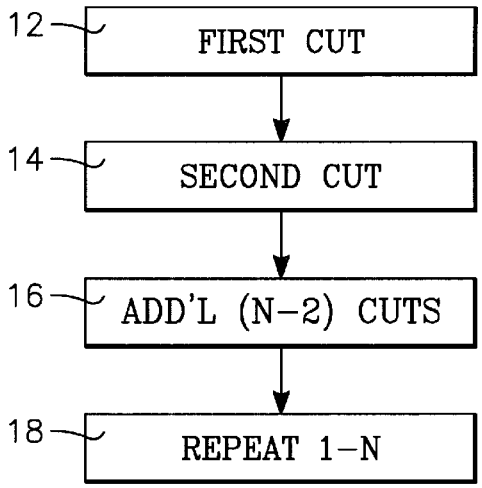
FIG. 2 illustrates a flow chart setting forth steps included in an embodiment of the present invention.
Figure 3:
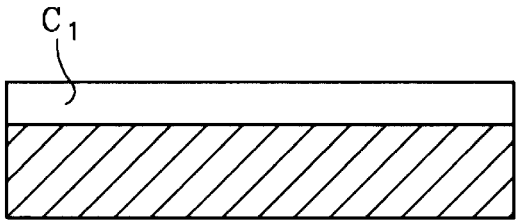
FIGS. 3 and 4 illustrate cross-sectional views of a blank during the cutting process.
Figure 3A:
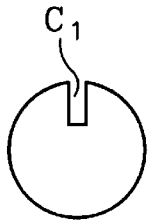

As shown generally in FIG. 2, the method of the present invention uses a series of incremental cuts along the longitudinal axis of the blank 10 to cut the blank into pieces. At 12 of FIG. 2, a first substantially planar cut C1 is made in the blank 10. As illustrated in FIG. 3, the cut C1 extends substantially along the entire length L of the blank 10, and substantially less than the entire width (here the diameter D) of the blank 10.

Figure 4:
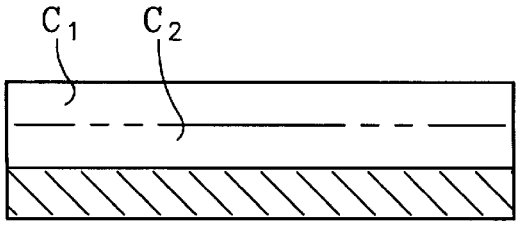
Figure 4A:
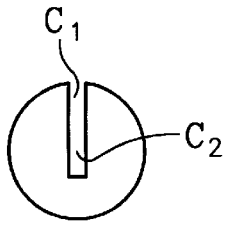
Figure 5:
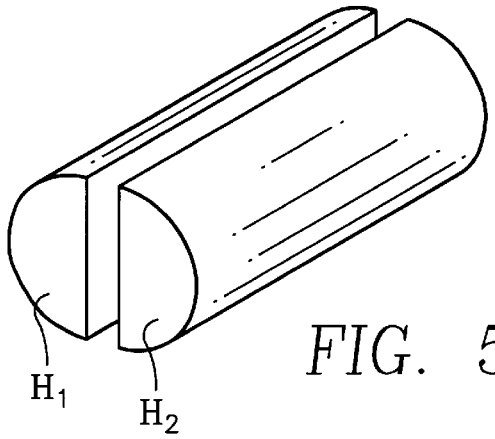
FIGS. 5 through 7 illustrate various steps included in the method of the present invention.

At 14 of FIG. 2, an additional cut C2 is made in the blank 10. As illustrated in FIG. 4, the cut C2 extends in the same plane as the first cut C1. If the blank 10 is of relatively small diameter, two cuts may suffice to cut the blank into halves, H1 and H2, as illustrated in FIG. 5. Otherwise, additional cuts C3 through CN may be required, as indicated at 16 of FIG. 2. For a typical blank having a diameter of 3", it has been found that 3 cuts achieve good results.

Cutting of the blank 10 may be accomplished through any suitable technique. It is presently contemplated that the described cuts can be effectively accomplished by using a rotary saw, such as a model M4K34F21G manufactured by MK. The saw can be equipped with a diamond-tipped blade, for example, part number 10125D22 or 10125D100, manufactured by National Diamond Lab. During cutting of the blank, it is contemplated that the saw can be operated at speeds ranging from 50 rpm to 50,000 rpm. It has been discovered that a speed of approximately 4,000 rpm is particularly effective. It is to be understood that the use of a rotary saw, while effective, is merely illustrative. It is contemplated that alternative cutting apparatus could be employed to achieve acceptable results. Examples of such apparatus include, but are not limited to, saws using non-diamond blades, lasers, wire saws, abrasive saws, reciprocating saws, and abrasive fluid cutting devices.

Figure 6:
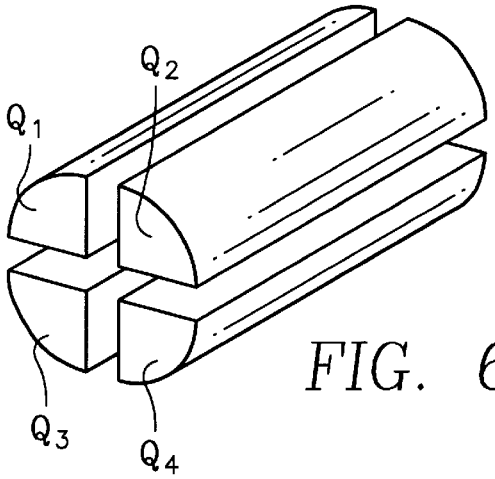

Frequently, the fabrication of structural support members may be enhanced by providing pieces smaller than the half-blanks shown in FIG. 5. In such instances, the incremental cutting steps described can be repeated on each of the two pieces to make four pieces Q1 through Q4 from the original blank 10, as shown in FIG. 6.

Figure 7:
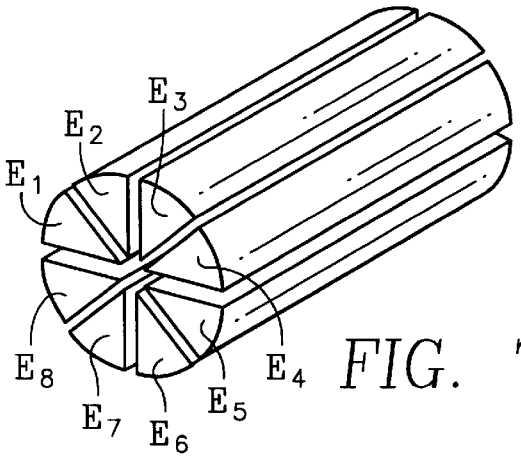
Figure 8:
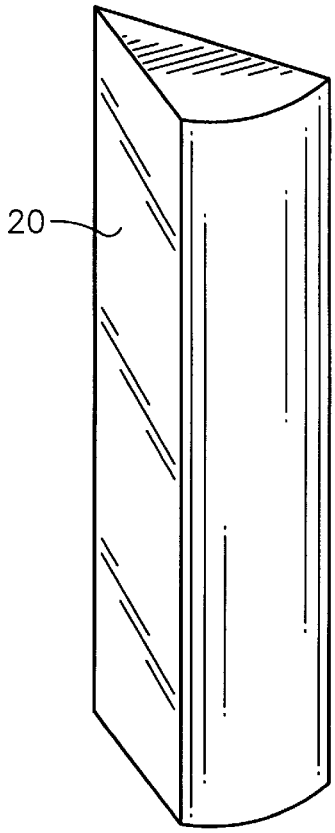
FIG. 8 illustrates a support member resulting from the method of the present invention.

In the fabrication of structural members such as those described in U.S. Ser. No. 09,292,495, it is desirable to begin with a support member basic form 20 as shown in FIG. 8. The support member basic form 20 is made by repeating the incremental cutting steps on each of the four pieces Q1 through Q4 to yield eight pieces E1 through E8 from the original blank 10, as shown in FIG. 7. Each of the eight pieces having a substantially wedge-shaped cross-section, and can be subsequently machined as described in U.S. Ser. No. 09,292,495.

The present invention enables the fabrication of monocrystalline and polycrystalline silicon structural members for use in the manufacture of semiconductor wafers and the like, and is applicable to any large scale and/or complex fixture or part used in the processing of silicon wafers. Components using structural members in accordance with the present invention eliminate deformation during high-temperature process applications. Since the source material is the same quality as the wafers material, particulate contamination and "crystal slips" inherent with known materials such as silicon carbide is virtually eliminated. Furthermore, there is no shadowing, since the source material provides a one-to-one duplication of the physical properties and critical constants of process wafers. Monosilicon fixtures and parts provide tolerances and expected service life unachievable with those made from commonly-used materials such as quartz or silicon carbide. The present invention also enables the fabrication of silicon parts and fixtures that provide advantages as the industry moves to 300 mm and larger wafer diameters.

Although the present invention has been described with reference to specific embodiments, those of skill in the art will recognize that changes may be made thereto without departing from the scope and spirit of the invention.

What is claimed is:

1. A method for fabricating elongate structural members, comprising the steps of:

providing a unitary blank of crystalline silicon material extending along an axis;

a first step of cutting said unitary blank along said axis to provide first and second submembers; and a second step of cutting said first and second submembers along said axis to provide at least four sub-submembers.

2. The method of claim 1, wherein said first step of cutting comprises making at least two progressively deeper cuts along said axis.

3. The method of claim 1, wherein said first and second steps of cutting comprise making cuts using a rotary saw.

4. The method of claim 3, wherein said rotary saw has diamond-coated cutting surfaces.

5. The method of claim 3, wherein said step of making cuts includes rotating a blade of said rotary saw at between 50 rpm and 50,000 rpm.

6. The method of claim 5, wherein said rotating step rotates said blade at approximately 4000 rpm.

7. The method of claim 1, wherein said first and second steps of cutting include cutting with a fluid.

8. The method of claim 6, wherein said fluid is an abrasive fluid.

9. The method of claim 1, wherein said unitary blank of crystalline silicon material comprises monocrystalline silicon material.

10. The method of claim 9, wherein said unitary blank is substantially cylindrical.

11. The method of claim 1, wherein said unitary blank of crystalline silicon material comprises polycrystalline silicon material.

12. The method of claim 11, wherein said unitary blank is substantially cylindrical.

13. The method of claim 1, wherein said unitary blank is substantially cylindrical and said submembers arc substantially shaped as cylindrical halves.

14. The method of claim 3, wherein said sub-submembers are substantially wedge shaped.

15. The method of claim 11, wherein at least eight sub-submembers are formed.

16. A method for fabricating elongate structural members from a unitary substantially cylindrically shaped blank of crystalline silicon material extending along a cylindrical axis thereof, comprising the steps of:

a first step of cutting said blank along said axis into two substantially cylindrical halves; and a second step of cutting said halves along said axis to form at least four submembers.

17. The method of claim 6, wherein said crystalline silicon material comprises monocrystalline silicon material.

18. The method of claim 6, wherein said crystalline silicon material comprises polycrystalline silicon material.

19. The method of claim 6, further comprising a third step of cutting said submembers along said axis to provide at least eight sub-submembers.

20. The method of claim 9, wherein said sub-submembers are substantially wedge shaped.

* * * * *